US008984716B2

(12) United States Patent
Proctor et al.

(10) Patent No.: US 8,984,716 B2
(45) Date of Patent: Mar. 24, 2015

(54) ROLLER WHEEL CARRIAGE AND BEARING ASSEMBLY

(71) Applicant: Anthony Innovations Pty, Ltd., Thomastown (AU)

(72) Inventors: Nigel Proctor, Thomastown (AU); Derek Jefferson, Thomastown (AU)

(73) Assignee: Anthony Innovations Pty Ltd. (AU)

( * ) Notice: Subject to any disclaimer, the term of this patent is extended or adjusted under 35 U.S.C. 154(b) by 0 days.

(21) Appl. No.: 14/167,475

(22) Filed: Jan. 29, 2014

(65) Prior Publication Data

US 2014/0237769 A1 Aug. 28, 2014

(30) Foreign Application Priority Data

Feb. 25, 2013 (AU) ..... 2013900632

(51) Int. Cl.
*E05D 15/06* (2006.01)

(52) U.S. Cl.
CPC ..... *E05D 15/063* (2013.01); *Y10T 16/381* (2015.01)
USPC ..... 16/97

(58) Field of Classification Search
CPC ..... E05D 15/063; E05D 15/0634; E05D 15/0639; E05D 15/066; E05D 15/0665; E05D 15/0669; E05D 15/0673; E05D 15/0621; E05Y 2201/64; F16C 13/02; Y10T 16/35; Y10T 16/381; Y10T 16/3813; Y10T 16/3816; Y10T 16/3819; Y10T 16/3822; Y10T 16/3825; Y10T 16/3828; Y10T 16/3831; Y10T 16/3834; Y10T 16/3837; Y10T 16/384
USPC ..... 16/87 R, 97–107; 49/409, 425; 160/196.1, 214; 384/418
See application file for complete search history.

(56) References Cited

U.S. PATENT DOCUMENTS

| | | | | | |
|---|---|---|---|---|---|
| 3,093,424 | A * | 6/1963 | Pernetta | 384/10 |
| 3,708,827 | A * | 1/1973 | Foltz | 16/98 |
| 4,538,323 | A * | 9/1985 | Johnson | 16/98 |
| 4,589,345 | A * | 5/1986 | Fujita | 105/170 |
| 4,633,615 | A * | 1/1987 | Moose | 49/425 |
| 4,846,249 | A * | 7/1989 | Cooper et al. | 160/345 |
| 5,016,318 | A * | 5/1991 | Harris | 16/95 R |
| 6,021,547 | A * | 2/2000 | Stagoll | 16/105 |
| 6,370,734 | B1 * | 4/2002 | Ryan | 16/93 R |
| 6,745,813 | B2 * | 6/2004 | Yorgason | 160/199 |
| 7,891,052 | B2 * | 2/2011 | Haab et al. | 16/98 |
| 7,962,998 | B2 * | 6/2011 | Proctor et al. | 16/97 |
| 8,046,872 | B2 * | 11/2011 | Burgess et al. | 16/97 |
| 8,522,398 | B2 * | 9/2013 | Haab et al. | 16/105 |
| 2013/0205542 | A1 * | 8/2013 | Backman et al. | 16/102 |

* cited by examiner

*Primary Examiner* — William Miller
(74) *Attorney, Agent, or Firm* — Miller Law Group, PLLC

(57) ABSTRACT

The present specification discloses a carriage body (10) and a bearing (24) as a sub assembly for use in a roller wheel assembly (32), the bearing (24) centrally supporting a roller wheel supporting shaft (27) for rotation, in use, about a rotation axis defined by the rotation shaft (27), the bearing (24) having an outer peripheral mounting surface (50), the carriage body (10) being in one piece defining a bearing support cavity (17) providing a support surface (23) engaging at least a portion of the outer peripheral mounting surface (50) of the bearing (24), the one piece carriage body (10) further having a bearing access opening (28) whereby the bearing (24) is operationally positioned in the bearing support cavity (17) by movement through the access opening (28) in a direction transverse to the rotation axis defined by the support shaft (27).

18 Claims, 4 Drawing Sheets

ROLLER WHEEL CARRIAGE AND BEARING ASSEMBLY

FIELD OF THE INVENTION

The present invention relates to improvements in roller wheel assemblies comprised of at least one pair of wheels supported at opposed ends of a shaft that is supported by a bearing carried by a carriage member.

BACKGROUND TO THE INVENTION

The roller wheels of a roller wheel assembly are typically, in use, arranged to roll along a metal track, having a specific path for each roller wheel of the pair of roller wheels. Sometimes, multiple pairs of roller wheels may be provided in particular assemblies. Such assemblies are often used as an elevated rolling support for doors, windows and the like including but not limited to cavity door rolling supports. Other applications may include a variety of conveyors, particularly overhead conveyors. There are a number of known methods for mounting the bearing in the body of the carriage member including making the carriage member body in two or more parts that are connected by fasteners around the bearing, directly moulding a plastics material body about the bearing (or bearings), and press fitting the bearing in an axial direction into a purpose formed cavity for the bearing. Such arrangements are usually characterized by the outer peripheral surface of the bearing being fully supported by the body of the carriage member. Such known arrangements, while working satisfactory, have a number of disadvantages including the difficulty of the assembly process and the costs of the material required for the body of the carriage member. All these have an adverse affect on the costs of roller wheel assembly over all. The objective of the present invention is to provide an improved structure for a carriage member body for mounting at least one bearing thereto for use in a roller wheel assembly of the above discussed type.

SUMMARY OF THE INVENTION

According to the present invention there is provided a carriage body and bearing sub assembly for use in a roller wheel assembly, said bearing having a central opening defining a rotation axis of a roller wheel supporting shaft, said bearing having an outer peripheral mounting surface, said carriage body being one piece and being characterized by a bearing support cavity having an access region opening in a first face of said carriage body, said bearing support cavity defining a support surface means, in use, engaging with a portion of the outer peripheral mounting surface of said bearing, said bearing being positioned in said bearing support cavity by movement through said access region in a direction transverse to said rotation axis. Conveniently the aforesaid first face faces in a load carrying direction of said carriage body and bearing sub assembly. Preferably said carriage body includes load carrying means for carrying a load whereby, in use, the load applies a force to said carriage body in a direction to urge said portion of the outer peripheral mounting surface of said bearing against said support surface means of said bearing support cavity.

The above defined arrangement permits easy assembly of the bearing (or bearings) with the carriage body without the difficulties and costs associated with previously known manufacturing techniques. Once the roller wheel shaft and the roller wheels are connected with the shaft, the bearing (or bearings) are operationally retained in position. When the roller wheel assembly is positioned in use on a rolling track, load on the sub assembly keeps the bearing operationally in position within the single piece carriage body. If it is desired to keep the bearing in place in its operational position in the bearing support cavity, retainer means may be provided to keep the bearing operationally positioned.

Preferably said outer peripheral mounting surface of said bearing is circular and said support surface means includes at least one bearing engagement location, the, or each said bearing engagement location together, defining a semi-circular contact zone for a portion of the outer peripheral mounting surface of said bearing. Conveniently the semi-circular contact zone is formed by a continuous semi-circular surface. The semi-circular contact zone in the bearing support cavity may occupy 180° or less.

In a preferred arrangement, the aforesaid semi-circular contact zone has a generally uniform width in the axial direction corresponding to a width of said outer peripheral mounting surface of said bearing. The outer peripheral mounting surface of the bearing may be annular and generally parallel to the rotation axis.

Conveniently, adjacent to the semi-circular contact zone, at least one region may be provided having a smaller radius of curvature than a radius of curvature of said semi-circular contact zone, being adapted to retain said bearing in said bearing support cavity.

In an alternative arrangement, retainer means may be provided to retain said bearing in said bearing support cavity. Conveniently, the retainer means may include at least one integrally formed formation on said carriage body adjacent said bearing support cavity. The retainer means may enable the bearing to be forced past said retainer means into said bearing support cavity but inhibit movement of the bearing in a reverse direction.

Preferably the carriage body may include a first wall means and a second wall means generally on opposed sides of said bearing support cavity extending from said first face, each of said first and said second wall means having aperture means enabling a said roller wheel supporting shaft to pass therethrough and through said bearing support cavity, at least one of said first and said second wall means being continuous in said first face. Conveniently both said first and said second walls means are continuous in said first face.

In many preferred arrangements, the carriage body may have a plurality of said bearing support cavities, each having a separate said access region to said first face and each carrying a said bearing. Conveniently, the multiple said bearings are arranged in substantially the same plane.

In a further preferred aspect of this invention, a roller wheel assembly is provided including a carriage body and bearing sub assembly according to any one of the options defined in the foregoing, the roller wheel assembly further including a roller wheel supporting shaft carried by the or each said bearing, the or each said roller wheel supporting shaft carrying a roller wheel on each lateral end of said shaft. In a preferred aspect the roller wheel assembly may also include a hanger rod threaded into a retainer nut held within a retainer nut cavity in said carriage body, said hanger rod passing through an aperture in said first face, said retainer nut cavity being substantially open in a face opposite said first face except for diametrally opposed retainer tabs engaging said retainer nut.

Further preferred features of the present invention will become apparent from the following description of preferred embodiments given in relation to the accompanying drawings.

BRIEF DESCRIPTION OF THE DRAWINGS

FIG. 14 is an exploded perspective view of the roller wheel assembly shown in FIG. 10.

DETAILED DESCRIPTION OF THE PREFERRED EMBODIMENTS

Figure 1:
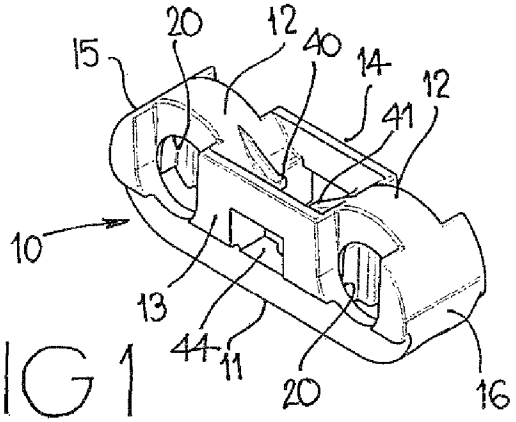
FIG. 1 is a perspective view of an integrally moulded plastic material carriage body according to one preferred embodiment.
Figure 5:
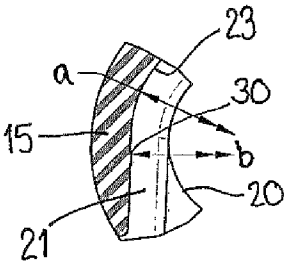
FIG. 5 is a detailed view of the area marked A in FIG. 3.
Figure 4:
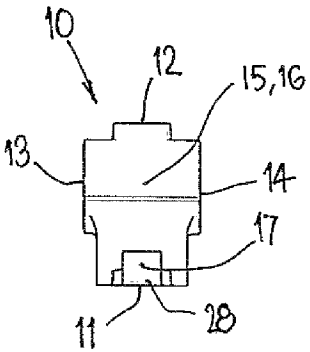
FIG. 4 is an end view from either end of the carriage body shown in FIG. 1.
Figure 2:
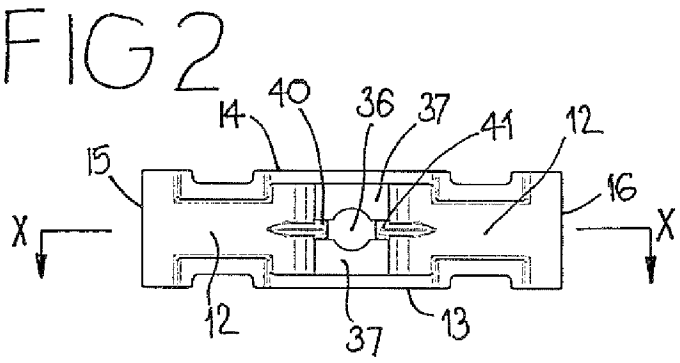
FIG. 2 is a top plan view of FIG. 1.

Referring first to FIGS. 1 to 5, a one piece carriage body 10 is illustrated that may be moulded from any suitable plastics material that has the strength and hard wearing capabilities for the intended application. The carriage body 10 has a lower first face 11, an upper second face 12, a first side wall 13, a second side wall 14 and opposed end walls 15, 16. As is apparent from the drawings, the aforesaid faces and walls are not necessarily continuous or flat. As will be apparent from the following, the carriage body 10 illustrated is intended to enable a roller wheel assembly having four roller wheels mounted on two spaced parallel shafts, however, it is possible to ultimately provide roller wheel assemblies having one pair of roller wheels mounted to a single shaft up to any number of pairs of roller wheels, depending on application and required load carrying capacity.

Figure 3:
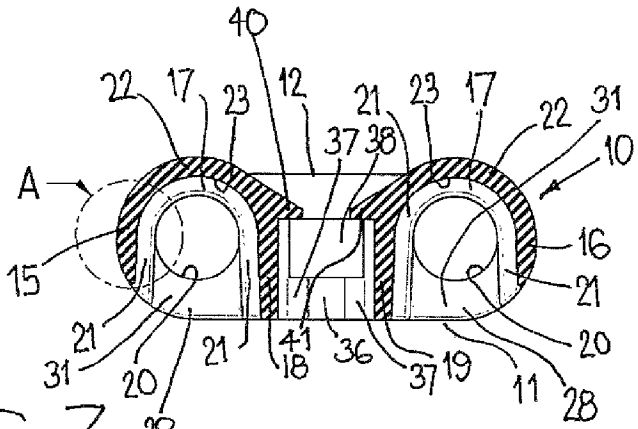
FIG. 3 is a section view along line X-X of FIG. 2.
Figure 6:
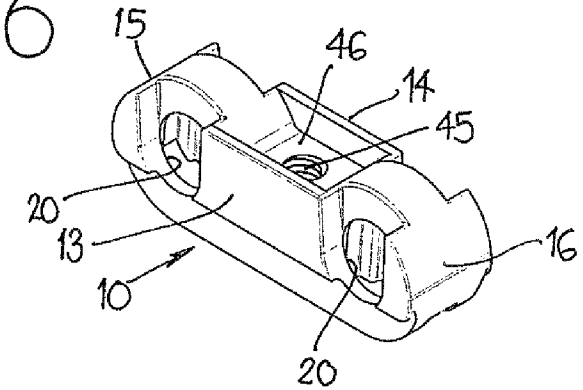
FIG. 6 is a perspective view of a carriage body similar to FIG. 1 where the carriage body is made by a metal die casting procedure.
Figure 9:
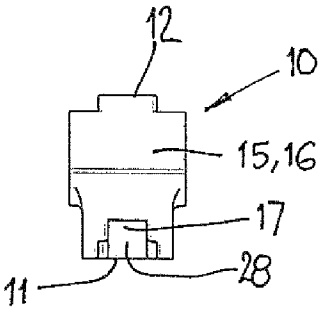
FIG. 9 is an end view of either end of the carriage body shown in FIG. 6.
Figure 7:
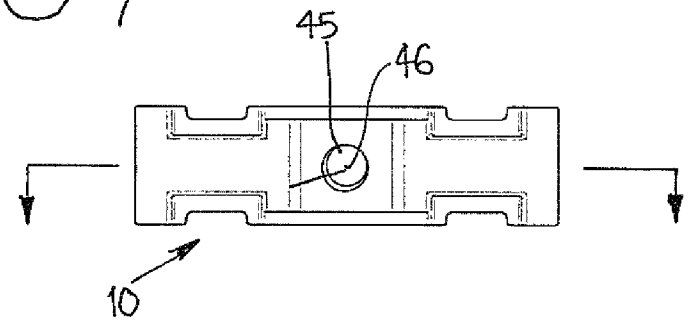
FIG. 7 is a top plan view of FIG. 6.
Figure 8:
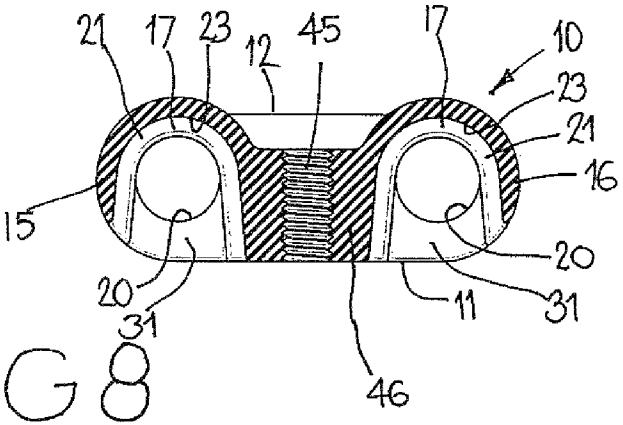
FIG. 8 is a section view along line X-X of FIG. 7.

As shown in FIG. 3, a pair of spaced bearing support cavities 17 are provided each being located between end walls 15, 16 and respective intermediary walls 18, 19 extending between the side walls 13, 14. Each of the side walls 13, 14 have an opening 20 leading into the bearing support cavity 17. Each of the side walls 13, 14 further include a ledge region 21 extending from the first face 11 upwardly into the bearing support cavity 17 and around the opening 20 returning again to the first face 11. The distance between the ledge regions 21 on each of the side walls 13, 14 generally equals the axial thickness of the outer face of the bearing to be installed. The inner surfaces facing inwardly of the bearing support cavities 17 of the end walls 15, 16, the intermediary walls 18, 19 and the wall 22 providing a substantial part of the second face 12, provide support for the peripheral surface of the outer ring of the bearing, either as the bearing enters the bearing support cavity 17 or as the bearing is operationally seated on the bearing support cavity 17 with said peripheral surface of the outer ring of the bearing seated against the inner surface 23 of the wall 22.

Figure 12:
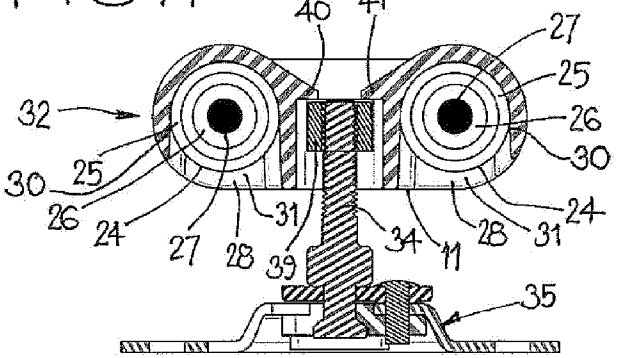
FIG. 12 is a section view along line X-X of FIG. 11.
Figure 4:
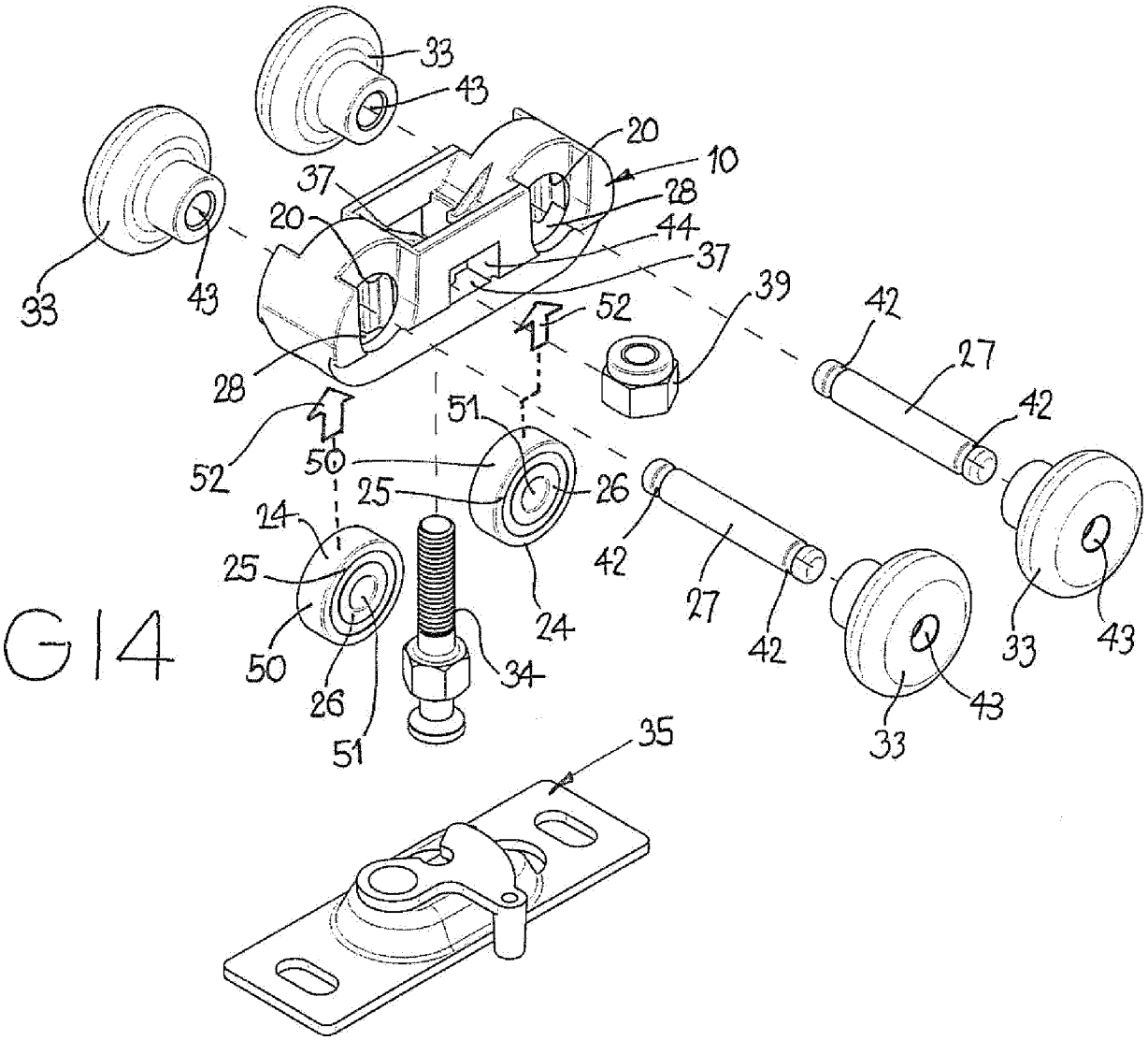

Conventionally, the peripheral surface 50 of the outer ring 25 of the bearing 24 will be circular and the inner surface 23 forming a support surface of the bearing support cavity 17 is semicircular having substantially equal radius of curvatures as this provides maximum bearing support for the outer ring 25 of the bearing 24. This structure is not, however essential for the performance of the present invention. The width of the surface 50 in the axial direction is substantially equal to the width of the surface 23 in an axial direction. The width of the ledge regions 21 that is, the distance from the surface 23 to the edge of the opening 20 is sufficient to support the outer ring 25 of the bearing but not so much as to obstruct the inner ring 26 of the bearing 24. FIG. 12 schematically illustrates the bearings 24 in the bearing support cavities 17 with the outer ring 25 engaged against the surface 23, and the inner ring 26 supporting a roller wheel support shaft 27 having a rotation axis out of the plane of the paper, i.e. transverse to the openings 20 in the side walls 13, 14. As illustrated, the support surface 23 is semicircular occupying about 180°, however the support surface 23 might occupy a smaller angular distance or be broken up into separate support surfaces or locations. The surface 23 might have a uniform width in the axial direction and preferably will be flat in each radial plane and in each radial plane, will be parallel to the rotation axis. The surface 23 represented in the drawings is continuous but it is equally possible to have a series of circumferentially spaced bearing engagement locations that together form a semi-circular contact zone. The arrangement is, however such as to provide an open access region 28 in the first face 11 of the carriage body 10 that allows the bearing 24 to enter the bearing support cavity in a direction transverse to the rotation axis of the bearing or the shaft supported by bearing 24. The open access region 28 conveniently has a length equal to or greater than the diameter of the outer ring of the bearing 24. The width of the access region 28, i.e. the distance between the ledge regions 21 conveniently approximates the axial width of the bearing outer ring 25.

If it is desired that the bearing 24 be mechanically retained in the bearing support cavity 17, a region 30 of decreased radius b relative to the radius a of the surface 23 may be provided at the entrance to the region of the surface 23. This may provide a reduced distance zone less than the diameter of the bearing outer ring 24 at a position slightly lower than the maximum diameter of the bearing support cavity 17 to provide a retainer means that the bearing 24 can be readily pushed past into the cavity 17 but will be retained therein once it has been pushed into the cavity 17. While the region 30 provides one means of achieving this result, it will be apparent to those skilled in the art that many other forms of retainer means could be provided. For example, limited regions of increased thickness might be moulded on one or both ledges 21 acting as similar retainer means.

Figure 10:
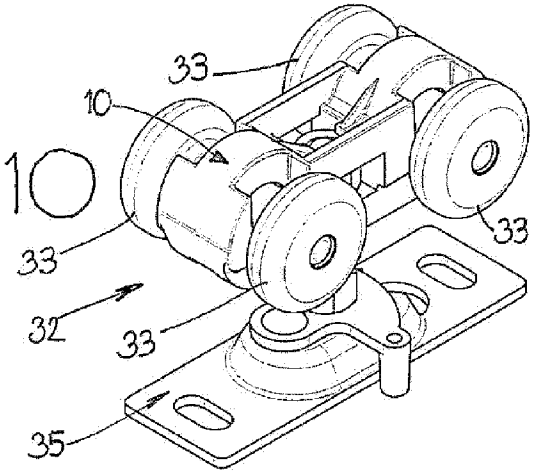
FIG. 10 shows in perspective view, one possible roller wheel assembly including the carriage body of FIGS. 1 to 5 together with bearings located in the bearing support cavity.
Figure 13:
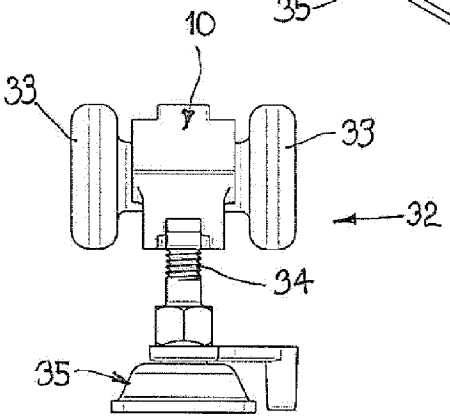
FIG. 13 is a forward end view of the assembly shown in FIG. 10.
Figure 11:
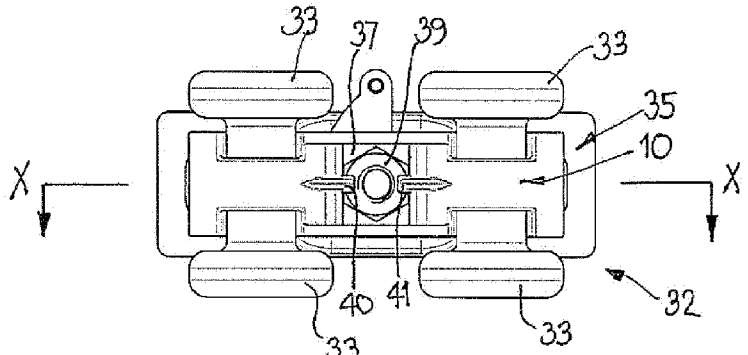
FIG. 11 is a top plan view of FIG. 10.

As can be seen in FIG. 12, and other figures, the side walls 13, 14 provide a region 31 below the shaft 27 that fully retains the shaft 27 and the bearing 24 in their operational position once the roller wheel assembly 32 is assembled as shown in FIG. 10 with roller wheels 33 secured to ends of the shafts 27. In use the roller wheel assembly 32 has a load applied to it in a downward direction (FIG. 12), i.e. in the same direction as the access region 28 is open, such that in use, this loading also prevents the bearing or bearings 24 from being dislodged from their operational position (FIG. 12).

FIG. 12 further illustrates a hanger rod 34 supporting an assembly structure 35 adapted to be connected in use, to a desired load, for example a sliding door, sliding window or the like. The upper end of the hanger rod 34 passes through an opening 36 in a wall 37 which connects between the intermediary walls 18, 19. The hanger rod 34 passes into a nut retaining cavity 38 containing a nut 39 and is screw threaded into the nut 39. A pair of small tabs 40, 41 defines the upper end of the nut retaining cavity 38 and is engaged with the nut 39. Conveniently, the nut 39 is a lock nut. The nut 39 might be placed in the cavity 38 through an opening 44 in the side wall 13.

FIG. 14 illustrates the assembly in exploded fashion. The shafts 27 preferably have circumferential grooves 42 adjacent their lateral ends that are engaged with ribs (not shown) in the bores 43 of the roller wheels 33 when assembled. The shafts 27, when assembled fit through the inner bore 51 of the bearings 24 and are rotationally supported by the inner bearing ring 26. Conveniently the bearings 24 can be press fitted into the support cavities 17 by being pressed in the direction of arrows 52 through the access openings 28. Once the bearings 24 are in an operational position in the cavities 17, the shafts 27 can be pressed through the bearing inner bores 51 with the shaft lateral ends extending through the openings 20 in the side walls 12, 13. In this condition the bearings 24 cannot fall out of the support cavities 17 with or without the bearing retainer means discussed above. Preferably, the roller wheels 33 can be press fitted into the ends of the shafts 27. While this structure is preferred, other known forms of connecting the roller wheels 33 to the shafts 27 can be employed.

FIGS. 1 to 5 and 11 to 14 show one possible arrangement of the carriage body 10 manufactured by moulding a suitable plastics material. FIGS. 6 to 10 illustrate another possible construction where the carriage body 10 is produced from a suitable metal. Any known construction process can be used including die casting, other casting process and forging. In this arrangement the hanger rod 34 might simply be screw threaded into a threaded bore 45 in a central zone 46. Other like features have been given the same reference numbers from the earlier described embodiments. Other variations may be possible within the scope of the annexed claims. For example, the carriage body 10 might be made in one piece but assembled with other parts in a complete assembly.

The invention claimed is:

1. A sub assembly including a carriage body and a bearing for use in a roller wheel assembly, said bearing having a central opening defining a rotation axis of a roller wheel supporting shaft, said bearing having an outer peripheral mounting surface, said carriage body being one piece and being characterized by a bearing support cavity having an access region opening in a first face of said carriage body, said bearing support cavity defining a support surface, engaging with a portion of the outer peripheral mounting surface of said bearing, said bearing being positioned in said bearing support cavity by movement through said access region in a direction transverse to said rotation axis.

2. The sub assembly according to claim 1 wherein said first face faces in a load carrying direction of said carriage body and bearing.

3. The sub assembly according to claim 1 wherein said carriage body cooperates with a load carrying apparatus whereby the load carrying apparatus applies a force to said carriage body in said load carrying direction to urge said portion of the outer peripheral mounting surface of said bearing against said support surface of said bearing support cavity.

4. The sub assembly according to claim 3 wherein said outer peripheral mounting surface of said bearing is circular and said support surface includes at least one bearing engagement location, the, or each said bearing engagement location together, defining a semi-circular contact zone for a portion of the outer peripheral mounting surface of said bearing.

5. The sub assembly according to claim 4 wherein said semi-circular contact zone is formed by a continuous semi-circular surface.

6. The sub assembly according to claim 4 wherein said semi-circular contact zone in said bearing support cavity occupies 180° or less.

7. The sub assembly according to claim 4 wherein said semi-circular contact zone has a generally uniform width in the axial direction corresponding to a width of said outer peripheral mounting surface of said bearing.

8. The sub assembly according to claim 7 wherein said outer peripheral mounting surface of said bearing is annular and generally parallel to said rotation axis.

9. The sub assembly according to claim 8 further including retainer means to retain said bearing in said bearing support cavity.

10. The sub assembly according to claim 9 wherein said retainer means includes at least one integrally formed formation on said carriage body adjacent said bearing support cavity.

11. The sub assembly according to claim 10 wherein said retainer means enables said bearing to be forced past said retainer means into said bearing support cavity but inhibits movement of the bearing in a reverse direction.

12. The sub assembly according to claim 4 wherein adjacent to said semi-circular contact zone, at least one region is provided having a smaller radius of curvature than a radius of curvature of said semi-circular contact zone being adapted to retain said bearing in said bearing support cavity.

13. The sub assembly according to claim 1 wherein said carriage body includes a first wall and a second wall generally on opposed sides of said bearing support cavity extending from said first face, each of said first and said second wall having aperture means enabling a said roller wheel supporting shaft to pass therethrough and through said bearing support cavity, at least one of said first and said second wall being continuous in said first face.

14. The sub assembly according to claim 13 wherein both said first and said second wall are continuous in said first face.

15. The sub assembly according to claim 1 further comprising a plurality of said bearings and a plurality of said bearing support cavities, each said bearing support cavity having a separate said access region to said first face and each carrying said bearing.

16. The sub assembly according to claim 15 wherein said bearings are arranged in substantially the same plane.

17. A roller wheel assembly comprising:

a carriage body and bearing having a central opening defining a rotation axis of a roller wheel supporting shaft, said bearing having an outer peripheral mounting surface, said carriage body being one piece and being characterized by a bearing support cavity having an access region opening in a first face of said carriage body, said bearing support cavity defining a support surface, engaging with a portion of the outer peripheral mounting surface of said bearing, said bearing being positioned in said bearing support cavity by movement through said access region in a direction transverse to said rotation axis.

18. The roller wheel assembly according to claim 17 further including a hanger rod threaded into a retainer nut held within a retainer nut cavity in said carriage body, said hanger rod passing through an aperture in said first face, said retainer nut cavity being substantially open in a face opposite said first face except for diametrally opposed retainer tabs engaging said retainer nut.

* * * * *